US006790010B2

(12) United States Patent
Chen et al.

(10) Patent No.: US 6,790,010 B2
(45) Date of Patent: Sep. 14, 2004

(54) SWITCHING SYSTEM FOR A RECIPROCATING PISTON PUMP

(75) Inventors: Chih-Kun Chen, Bade City (TW); Shan Chang Wang, Taoyuan Hsien (TW)

(73) Assignee: Nanya Technology Corporation, Taoyuan (TW)

( * ) Notice: Subject to any disclaimer, the term of this patent is extended or adjusted under 35 U.S.C. 154(b) by 0 days.

(21) Appl. No.: 10/316,354

(22) Filed: Dec. 11, 2002

(65) Prior Publication Data

US 2003/0123991 A1 Jul. 3, 2003

(30) Foreign Application Priority Data

Dec. 28, 2001 (TW) ..... 90133027 A

(51) Int. Cl.[7] ..... F04B 49/00; F04B 17/00; F04B 35/02; F01L 15/16; F15B 11/08

(52) U.S. Cl. ..... 417/46; 417/396; 417/397; 417/384; 91/323; 91/461

(58) Field of Search ..... 417/17, 46, 396, 417/397, 384; 91/323, 461

(56) References Cited

U.S. PATENT DOCUMENTS

| | | | | | |
|---|---|---|---|---|---|
| 2,755,966 | A | * | 7/1956 | Lindars | 222/23 |
| 3,516,763 | A | * | 6/1970 | Manton | 417/403 |
| 3,943,823 | A | * | 3/1976 | Tammy | 91/306 |
| 4,514,149 | A | * | 4/1985 | Kanebako et al. | 417/403 |
| 4,616,476 | A | * | 10/1986 | Oneyama et al. | 60/414 |
| 5,106,275 | A | * | 4/1992 | Santi et al. | 417/403 |
| 6,006,650 | A | * | 12/1999 | Adams | 91/446 |
| 6,126,403 | A | * | 10/2000 | Yamada | 417/46 |

* cited by examiner

*Primary Examiner*—Justine R. Yu
*Assistant Examiner*—Timothy P. Solak
(74) *Attorney, Agent, or Firm*—Quintero Law Office

(57) ABSTRACT

A pumping system. The pumping system has a cylinder pump, a first group of switching devices, and a second group of switching devices. The first group of switching devices enable the cylinder pump to pump the liquid by feeding the gas provided by the gas source into the cylinder pump through a first ventilator according to a first enabling signal, and the second group of switching devices enable the cylinder to output the liquid by feeding the gas provided by the gas source into the cylinder pump through a second ventilator according to a second enable signal.

20 Claims, 4 Drawing Sheets

SWITCHING SYSTEM FOR A RECIPROCATING PISTON PUMP

BACKGROUND OF THE INVENTION

1. Field of the Invention

The present invention relates to a pumping system whose output is regulated by gas provided by a gas source.

2. Description of the Related Art

In semiconductor processes, liquid supply is very important. For example, in chemical mechanical polish (CMP) and etching processes, it is very important to provide slurries and etching solutions accurately. Typically, conventional pumps are controlled by signals. Conventional pumps, however, cannot always output liquid stably because of unstable pressure caused by pulse signals. Thus, devices, for example, may be overetched or not etched completely if the liquid supply is not controlled accurately.

SUMMARY OF THE INVENTION

In view of this, an object of the present invention is to provide a pumping system with stable output. The present invention uses a plurality of switching devices to stably control the operation of a cylinder pump and its output.

Further, the present invention can control the speed of the cylinder pump by adjusting the gas flow of the needle valve. In addition, the present invention can control the output of the cylinder pump by adjusting the position of the hard stop at the piston linkage.

In the present invention, the pumping system pumps liquid and outputs regulated by gas provided by a gas source. The pumping system has a cylinder pump, a first group of switching devices, and a second group of switching devices. The first group of switching devices enable the cylinder pump to pump the liquid by feeding the gas provided by the gas source into the cylinder pump through a first ventilator according to a first enabling signal, and the second group of switching devices enable the cylinder to output the liquid by feeding the gas provided by the gas source into the cylinder pump through a second ventilator according to a second enabling signal. A control unit is coupled to the first and second groups of switching devices, and controls the gas entering and leaving the cylinder pump and the flow speed of the gas.

DESCRIPTION OF THE DRAWINGS

For a better understanding of the present invention, reference is made to a detailed description to be read in conjunction with the accompanying drawings, in which.

DETAILED DESCRIPTION OF THE INVENTION

Figure 1:
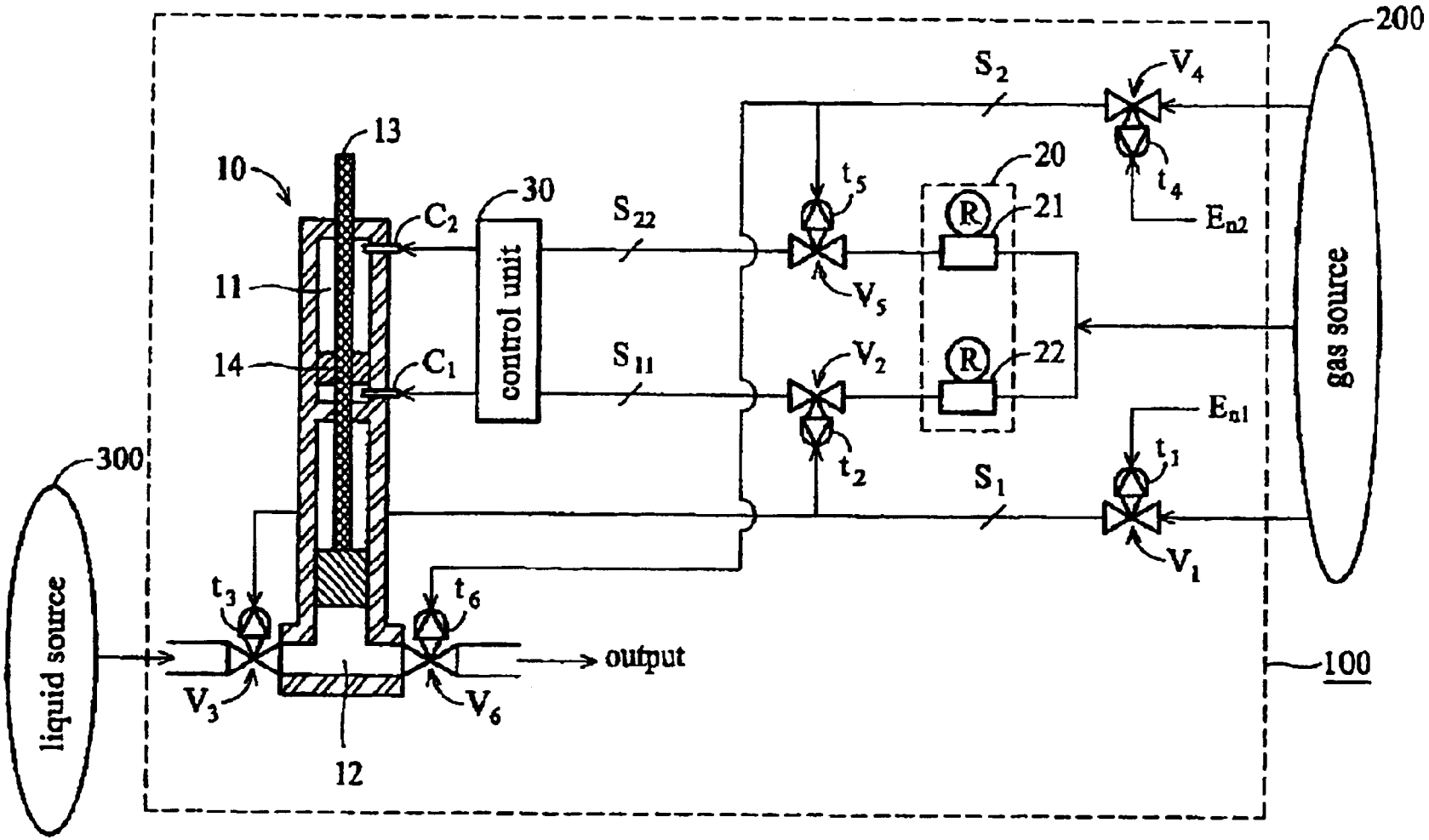
FIG. 1 is a diagram of the pumping system of the present invention.

FIG. 1 shows the pumping system 100 of the present invention. The pumping system 100 pumps liquid 300 regulated by gas provided by the source 200.

The first group of switching devices is composed of switching devices V1, V2 and V3. As well, the second group of switching devices is composed of switching devices V4, V5 and V6. The switching device V1 has an input terminal for receiving the gas provided by the gas source 200, and an enable terminal t1 for receiving a first enabling signal En1 from the external circuit. As well, the switching device V2 has an enable terminal t2 coupled to the output terminal of the switching device V1, and an input terminal for receiving the gas provided by the gas source 200. Also, the switching device V3 has an enable terminal t3 coupled to the output terminal of the switching device V1 and an input terminal coupled to the liquid source 300. The switching device V4 has an input terminal for receiving the gas provided by the gas source 200, and an enable terminal t4 for receiving a second enable signal En2 from the external circuit. As well, the switching device V5 has an enable terminal t5 coupled to the output terminal of the switching device V4, and an input terminal for receiving the gas provided by the gas source 200. Also, the switching device V6 has an enable terminal t6 coupled to the output terminal of the switching device V4 and an input terminal coupled to the cylinder pump 10.

When receiving the first enabling signal En1, the switching device V1 feeds the gas provided by the gas source 200 as a first enabling gas S1 to turn on the switching devices V2 and V3. Further, the switching device V2 feeds the gas provided by the gas source 200 as a first driving gas S11 and the switching device V3 feeds the liquid from liquid source 300 into the cylinder 10 when receiving the first enabling gas S1. Namely, switching devices V1, V2 and V3 enable the cylinder pump 10 to pump the liquid from the liquid source 300 by feeding the gas from the gas source 200 into the cylinder pump 10 through the ventilator C1 regulated by the first enabling signal En1.

In addition, when receiving the second enable signal En2, the switching device V4 feeds the gas provided by the gas source 200 as a second enable gas S2 to turn on the switching devices V5 and V6. The switching device V5 feeds the gas provided by the gas source 200 as a second driving gas S22 and the switching device V6 is turned on to output the liquid in the cylinder pump 10 when receiving the second enable gas S2. Namely, switching devices V4, V5 and V6 enable the cylinder pump 10 to output the liquid by feeding the gas into the cylinder pump 10 through the ventilator C2 regulated by the second enable signal En2. A control unit 30 is coupled between the first and second groups of switching devices and the cylinder pump 10 to control the gas entering and leaving the cylinder pump 10, and the flow speed of the first driving gas S11 and the second driving gas S22.

In this case, the switching devices V3 and V6 are normal closed pneumatic valves for liquid, and the switching devices V1, V2, V4 and V5 are normal closed pneumatic valves for gas. In addition, the first driving gas S11, the second driving gas S22, the first enabling gas S1 and the second enable gas S2 from the gas source 200, for example, are nitrogen gas (N2) or compressed dry air (CDA). Moreover, the first enabling signal En1 and the second enable signal En2 are signals from an external circuit, and can also be air signals.

Figure 2:
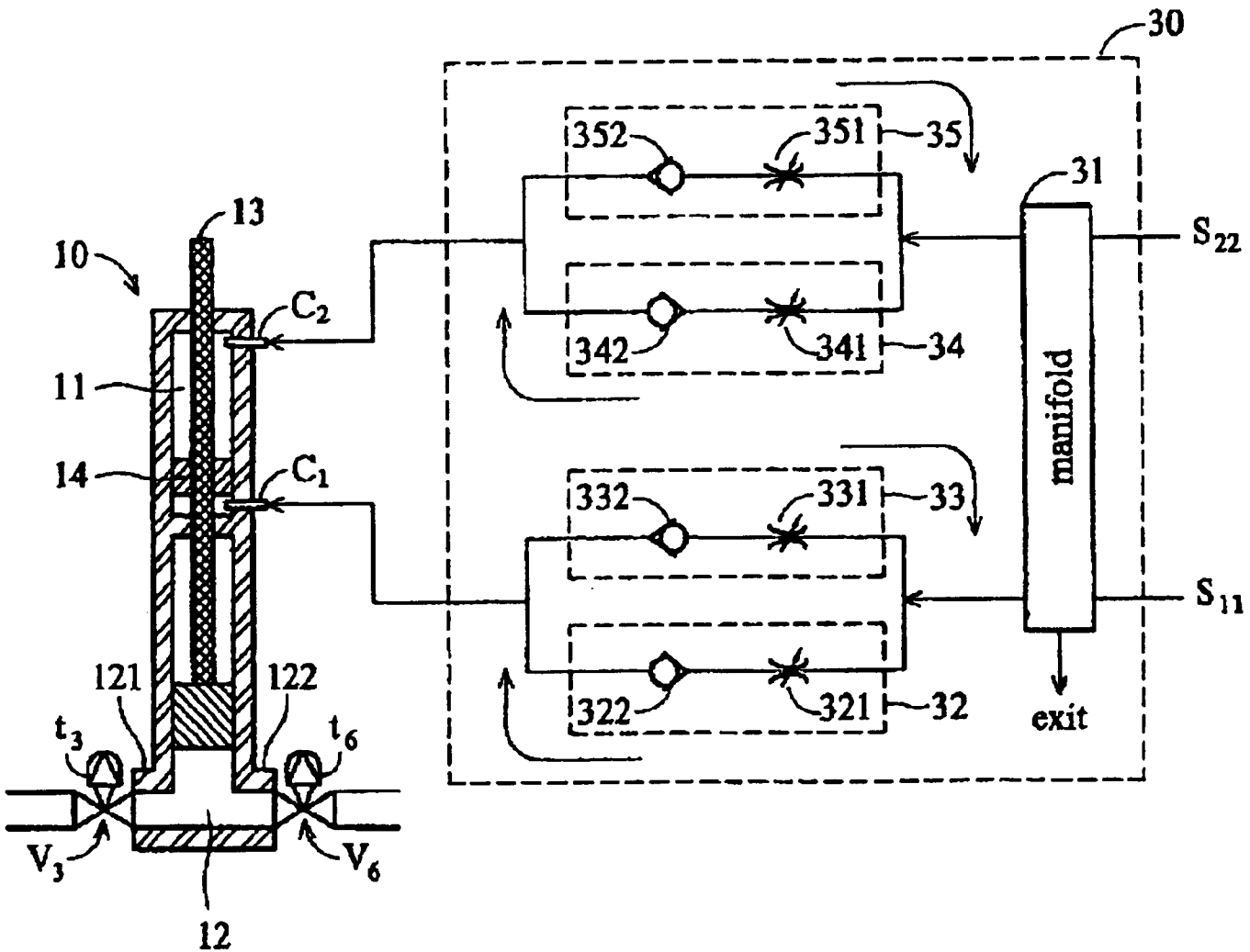
FIG. 2 shows the control unit and the cylinder pump of the present invention.

FIG. 2 shows a diagram of the control unit 30 and the cylinder pump 10 of the present invention. The control unit 30 is composed of a manifold 31, two forward paths 32 and 34, and two reverse paths 33 and 35. The manifold 31 is coupled to the switching device V2 and the switching device V5 to discharge the second driving gas S22 when receiving the first driving gas S11 and to discharge the first driving gas S11 when receiving the second driving gas S22. The forward path 32 and the reverse path 33 are coupled to the manifold 31, the forward path 32 feeds the first driving gas S11 into the cylinder pump 10, and the reverse path 33 outputs the first driving gas S11 from the manifold 31. The forward path 34 and the reverse path 35 are coupled to the manifold 31, the forward path 34 feeds the second driving gas S22 into the cylinder pump 10, and the reverse path 35 outputs the second driving gas S22 from the manifold 31.

Furthermore, the forward path 32 is composed of a check valve 322 and a needle valve 321, the reverse path 33 is composed of a check valve 332 and a needle valve 331, the forward path 34 is composed of a check valve 342 and a needle valve 341 and the reverse path 35 is composed of a check valve 352 and a needle valve 351. The forward path 32 is connected to the reverse path 33 in parallel, and the forward path 34 is connected to the reverse path 35 in parallel.

The flow directions of first driving gas S11 and the second driving gas S22 are controlled to flow in or out of cylinder pump 10 by the forward path, and the reverse path because the check valves 322, 332, 342 and 352 are one-way gas valves. Therefore, the present invention can control the flow direction of the first driving gas S11 and the second driving gas S22 by a forward connection or a reverse connection composed of check valves. Furthermore, the present invention can also control the flow speed of the first driving gas S11 and the second driving gas S22 entering and leaving the cylinder pump 10 by adjusting the flowing apertures of the needle valves 321, 331, 341 and 351. Thereby the present invention can control the pumping speed of the cylinder pump 10.

The cylinder pump 10 has a gas cavity 11, a liquid cavity 12 and a piston member. The gas cavity 11 has two ventilators C1 and C2 coupled to the switching device V2 and the switching device V5 (not shown in FIG. 2) respectively for receiving the first driving gas S11 and the second driving gas S22. The liquid cavity 12 has an input portion 121 and an output portion 122 coupled to the switching device V3 and the switching device V6 respectively. The piston member is disposed in the gas cavity 11 and the liquid cavity 12, and has a piston linkage 13 and a hard stop 14. The hard stop 14 is disposed between the ventilators C1 and C2 to move the piston member along the liquid cavity 12 to pump the liquid from the liquid source 300 and output the liquid regulated by the first driving gas S11 and the second driving gas S22. For example, the hard stop 14 is driven upward when the first driving gas S11 flows into the gas cavity 11 through the manifold 31, the forward path 32 and across the ventilator C1. Consequently, the piston linkage 13 is driven upward, thereby pumping the liquid into the cylinder pump 10 from the liquid source 300. The hard stop 14 is driven downward when the second driving gas S22 flows into the gas cavity 11 through the manifold 31, the forward path 34 and across the second ventilator C2. Consequently, the piston linkage 13 is driven downward, thereby outputting the liquid in the cylinder pump 10 through the switching device V6. Moreover, the position in which the hard stop is disposed at the piston linkage 13 can be adjusted regulated by the liquid requirement.

In addition, the pumping system 100 of the present invention may also have two gas adjusters 21 and 22 coupled between the switching device V2 and the gas source 200 and between the switching device V5 and the gas source respectively. The gas adjuster 21 adjusts the gas pressure of the gas input to the switching device V2, and the gas adjuster 22 adjusts the gas pressure of the gas input to the switching device V5.

Figure 3A:
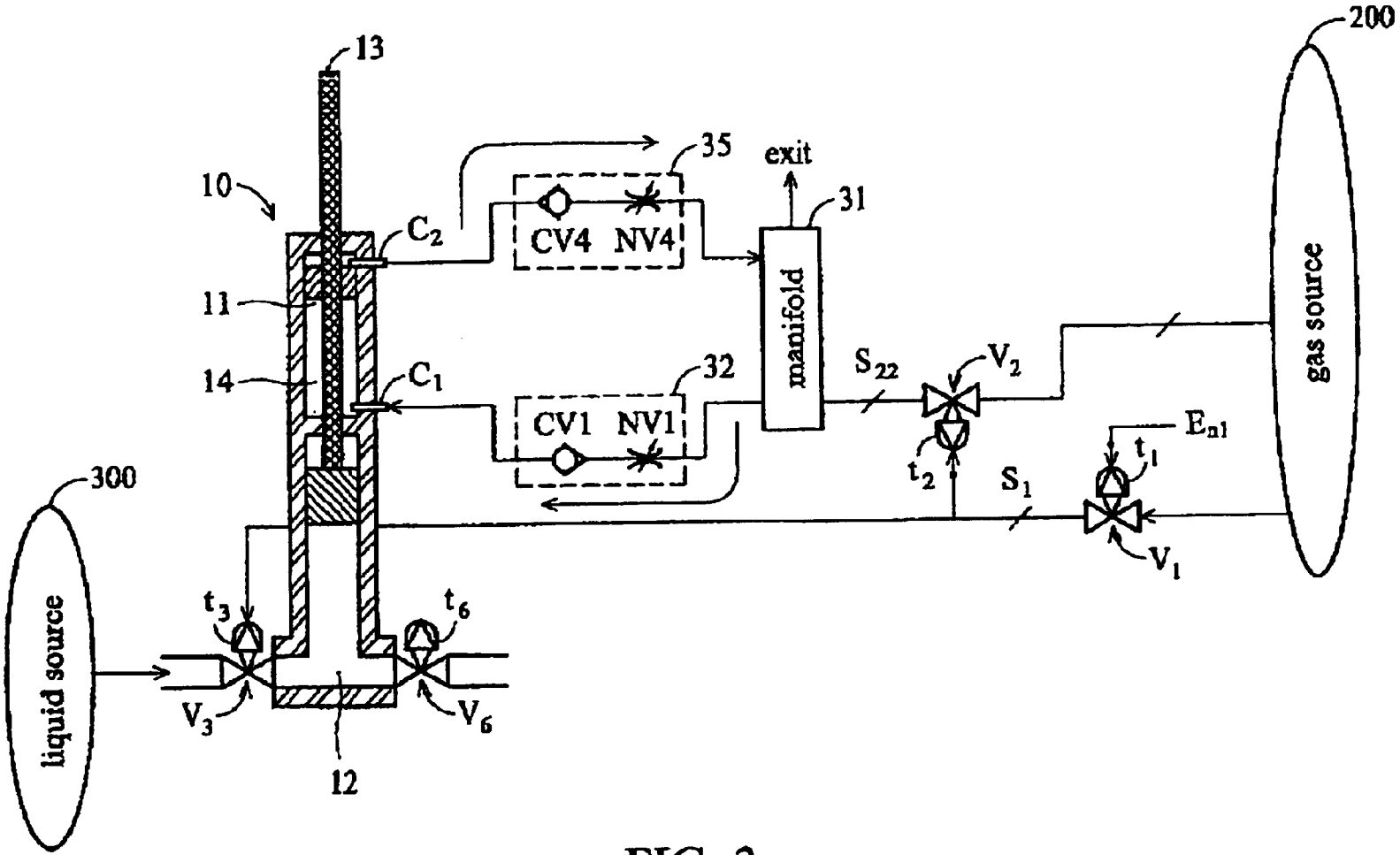
FIGS. 3*a* and 3*b* are operational diagrams of the pumping system of the present invention.
Figure 3B:
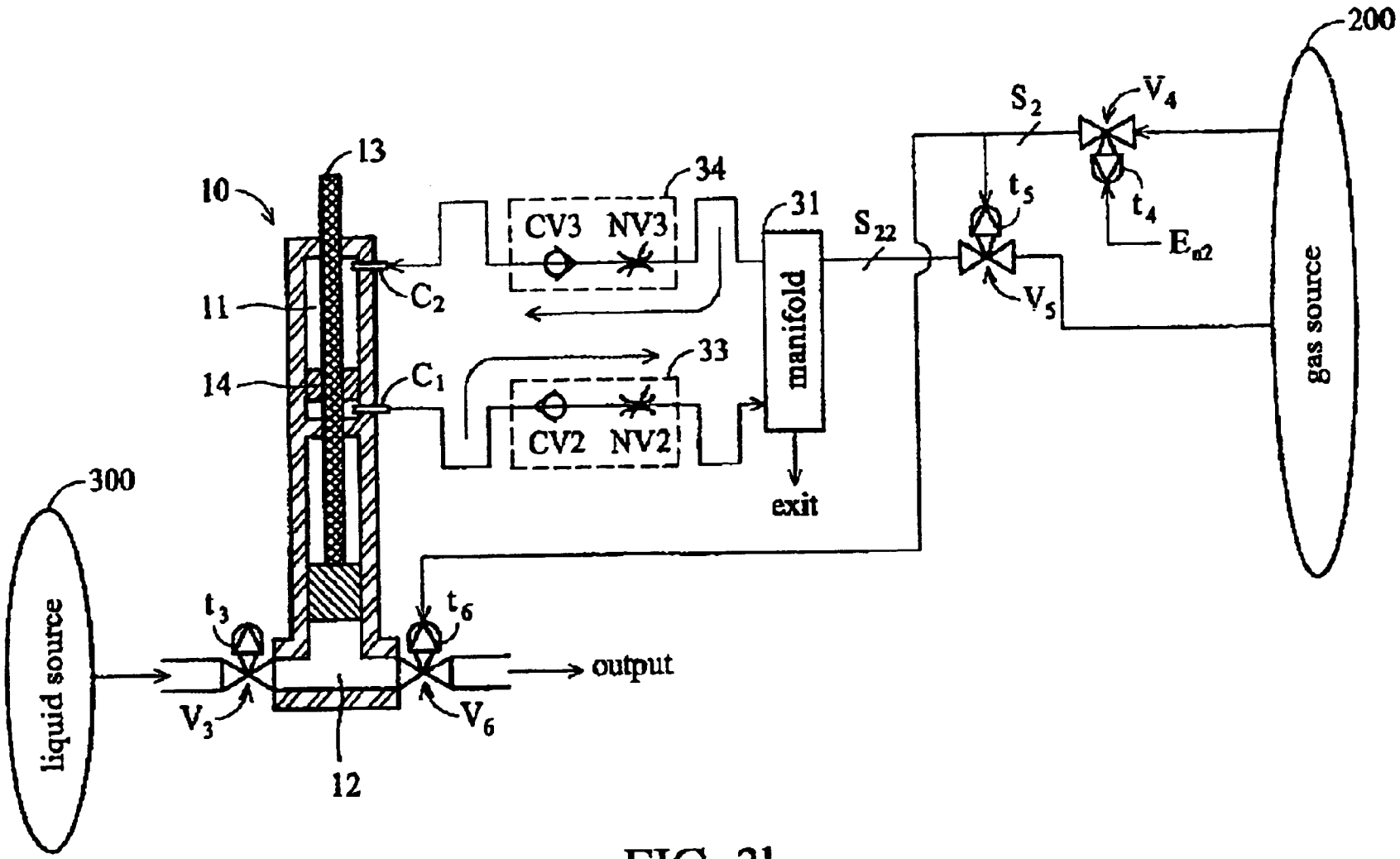

FIGS. 3*a* and 3*b* show operational diagrams of the pumping system of the present invention.

Pumping Mode

As shown in FIG. 3*a*, first, when receiving the first enabling signal En1 from an external circuit, the switching device V1 feeds the gas provided by the gas source 200 as the first driving gas S1 to output to the switching devices V2 and V3. Thus, the switching devices V2 and V3 are both turned on. Consequently, the switching device V2 feeds the gas provided by the gas source 200 as the first driving gas S22, and the first driving gas S22 also flows into the gas cavity 11 through the manifold 31, the forward path 32 and across the ventilator C1 to drive the hard stop 14 upward. Consequently, the liquid from the liquid source 300 can flow into the cylinder pump 10 through the switching device V3, and the piston linkage 13 is driven upward, thereby pumping the liquid into the cylinder pump 10 from the liquid source 300.

Moreover, the gas in the gas cavity 11, for example the second driving gas S22, is discharged by the manifold 31 through the ventilator C2 and the reverse path 35 when the hard stop 14 is driven upward.

Output Mode

As shown in FIG. 3*b*, the switching device V4 feeds the gas provided by the gas source 200 as the second driving gas S2 when receiving the second enable signal En2 from external circuit. Thus, the switching devices V4 and V5 are both turned on. Consequently, the switching device V5 feeds the gas provided by the gas source 200 as the second driving gas S22, and the first driving gas S22 flows into the gas cavity 11 through the manifold 31, the forward path 34 and across the second ventilator C2 to drive the hard stop 14 downward. Consequently, the piston linkage 13 is driven downward and the liquid in the cylinder pump 10 is output outside through the switching device V6, thereby outputting the liquid in the cylinder pump 10 through the switching device V6.

Moreover, the gas in the gas cavity 11, for example the second driving gas S11, is discharged by the ventilator C2 through the reverse path 33 and the manifold 31 when the hard stop 14 is driven downward.

Thus, the pumping system of the present invention enables the cylinder pump to pump liquid and then output it stably by turning on the switching devices alternately. Also, the liquid proving device can control the pumping speed of the cylinder pump 10 by adjusting the flowing apertures of the needle valves, and can further control the liquid output by adjusting the position in which the hard stop is disposed at the piston linkage 13.

While the invention has been described by way of example and in terms of the preferred embodiments, it is to be understood that the invention is not limited to the disclosed embodiments. To the contrary, it is intended to cover various modifications and similar arrangements (as would be apparent to those skilled the art). Thus, the scope of the appended claims should be accorded the broadest interpretation so as to encompass all such modifications and similar arrangements.

What is claimed is:

1. A pumping system regulated by gas provided by a gas source, comprising:

a cylinder pump to pump and output a liquid regulated by a first driving gas and a second driving gas, wherein the cylinder pump has a gas cavity with a first ventilator and a second ventilator, and a liquid cavity coupled to a liquid source;

a first group of switches in communication with the gas source and at least one of said first switches in further communication with the liquid source to enable the cylinder pump to pump the liquid by feeding the gas provided by the gas source as the first driving gas into the cylinder pump through the first ventilator when receiving a first enabling signal;

a second group of switches in communication with the gas source and at least one of said second switches in further communication with the liquid source to enable the cylinder pump to output the liquid by feeding the gas provided by the gas source as the second driving gas into the cylinder pump through the second ventilator when receiving a second enabling signal; and a control unit coupled to the first and second groups of switches and the cylinder pump, to control the first driving gas and the second driving gas entering and leaving the cylinder pump and the flow speed of the first driving gas and the second driving gas.

2. The pumping system as claimed in claim 1, wherein the first group of switches and the second group of switches comprise:

a first switching device coupled to the gas source, feeding the gas provided by the gas source as the first enabling gas when receiving a first enabling signal;

a second switching device coupled to the liquid source, feeding the gas provided by the gas source as the first driving gas when receiving the first enabling gas;

a third switching device coupled to the liquid source, having an enabling terminal coupled to the first switching device, and feeding the liquid into the cylinder pump from the liquid source regulated by the first enabling gas;

a fourth switching device coupled to the gas source, feeding the gas provided by the gas source as a second enabling gas when receiving a second enabling signal;

a fifth switching device coupled to the gas source, having an enable terminal coupled to the fourth switching device, and feeding the gas provided by the gas source as the second driving gas after receiving the second enabling gas; and a sixth switching device coupled to the cylinder, having an enabling terminal coupled to the fourth switching device, and outputting the liquid from the cylinder pump when receiving the second enabling gas.

3. The pumping system as claimed in claim 2, wherein in the cylinder pump, the first ventilator and the second ventilator are coupled to the second switching device and the fifth switching device respectively to receive the first driving gas and the second driving gas, and the liquid cavity has an input portion and an output portion coupled to the third switching device and the sixth switching device repectively, and the cylinder pump further comprises:

a piston member deposited in the gas cavity and the liquid cavity, having a piston linkage and a hard stop, wherein the hard stop is disposed between the first ventilator and the second ventilator to move the piston member along the liquid cavity to pump the liquid and output the liquid regulated by the first driving gas and the second driving gas.

4. The pumping system as claimed in claim 2, wherein the manifold is coupled between the second switching device and the fifth switching device to discharge the second driving gas when receiving the first driving gas and to discharge the first driving gas when receiving the second driving gas, and the control unit further comprises:

a first forward path and a first reverse path coupled to the manifold, wherein the first forward path feeds the first driving gas into the cylinder pump and the first reverse path outputs the first driving gas from the manifold; and a second forward path and a second reverse path coupled to the manifold, wherein the second forward path feeds the second driving gas into the cylinder pump and the second reverse path outputs the second driving gas from the manifold.

5. The pumping system as claimed in claim 4, wherein both the first forward path and the first reverse path are composed of a check valve and a needle valve, and the first forward path connects to the first reverse path in parallel.

6. The pumping system as claimed in claim 5, wherein both the second forward path and the second reverse path are composed of a check valve and a needle valve, and the second forward path connects to the second reverse path in parallel.

7. The pumping system as claimed in claim 6, wherein the check valves of the first forward path, the first reverse path, the second forward path and the second reverse path control the flow directions of the first driving gas and the second driving gas; and the needle valves of the first forward path, the first reverse path, the second forward path and the second reverse path control the flow speed of the first driving gas and the second driving gas.

8. The pumping system as claimed in claim 2, wherein the third switching device and the six switching devices are normal closed pneumatic valves for liquid, and the first switching device, the second switching device, the fourth switching device and the fifth switching device are normal closed pneumatic valves for gas.

9. A pumping system regulated by gases provided by a gas source, comprising:

a cylinder pump to pump and output a liquid regulated by a first driving gas and a second driving gas;

a first switching device coupled to the gas source, feeding the gas provided by the gas source as a first enabling gas when receiving a first enabling signal;

a second switching device coupled to the cylinder pump, feeding the gas provided by the gas source as the first driving gas when receiving the first enabling gas;

a third switching device coupled to the gas source, having an enabling terminal coupled to the first switching device, and the third switching device feeding the liquid from a liquid source into the cylinder pump regulated by the first enabling gas;

a fourth switching device coupled to the gas source, feeding the gas from the gas source as a second enabling gas when receiving a second enabling signal;

a fifth switching device coupled to the gas source, having an enabling terminal coupled to the fourth switching device, the fifth switching device feeding the gas from the gas source as the second driving gas when receiving the second enabling gas;

a sixth switching device coupled to the cylinder, having a terminal coupled to the fourth switching device, the sixth switching device outputting the liquid from the cylinder pump when receiving the, second enable gas.

10. The pumping system as claimed in claim 9, further comprising:

a first gas adjuster disposed between the gas source and the second switching device to adjust the gas pressure of the gas output to the second switching device;

a second gas adjuster disposed between the gas source and the fifth switching device to adjust the gas pressure of the gas output to the fifth switching device.

11. The pumping system as claimed in claim 9, further comprising a control unit coupled to the second switching device, the fifth switching device and the cylinder pump to adjust the first driving gas and the second driving gas entering and leaving the cylinder pump and the flow speed of the first driving gas and the second driving gas.

12. The pumping system as claimed in claim 9, wherein the cylinder pump comprises:

a gas cavity having a first ventilator and a second ventilator coupled to the second switching device and the fifth switching device respectively to receive the first driving gas and the second driving gas;

a liquid cavity having an input portion and an output portion coupled to the third switching device and the sixth switching device respectively;

a piston member disposed in the gas cavity and the liquid cavity, having a piston linkage and a hard stop, wherein the hard stop is disposed between the first ventilator and the second ventilator to move the piston member along the liquid cavity to pump the liquid and output the liquid regulated by the first driving gas and the second driving gas.

13. The pumping system as claimed in claim 9, wherein the control unit comprises:

a manifold coupled between the second switching device and the fifth switching device to discharge the second driving gas when receiving the first driving gas and discharge the first driving gas when receiving the second driving gas;

a first forward path and a first reverse path coupled to the manifold, wherein the first forward path feeds the first driving gas into the cylinder pump and the first reverse path outputs the first driving gas from the manifold;

a second forward path and a second reverse path coupled to the manifold, wherein the second forward path feeds the second driving gas into the cylinder pump and the second reverse path outputs the second driving gas from the manifold.

14. The pumping system as claimed in claim 13, wherein both the first forward path and the first reverse path are composed of a check valve and a needle valve, and the first forward path connects to the first reverse path in parallel.

15. The pumping system as claimed In claim 14, wherein both the second forward path and the second reverse path are composed of a check valve and a needle valve, and the second forward path connects to the second reverse path in parallel.

16. The pumping system as claimed in claim 14, wherein the check valves of the first forward path, the first reverse path, the second forward path and the second reverse path control the flow directions of the first driving gas and the second driving gas; and the needle valves of the first forward path, the first reverse path, the second forward path and the second reverse path control the flow speed of the first driving gas and the second driving gas.

17. The pumping system as claimed in claim 9, wherein the third switching device and the six switching device are normal closed pneumatic valves for liquid.

18. The pumping system as claimed in claim 9, wherein the first switching device, the second switching device, the fourth switching device and the fifth switching device are normal dosed pneumatic valves for gas.

19. The pumping system as claimed in claim 9, wherein the first driving gas and the second driving gas are nitrogen gas.

20. The pumping system as claimed in claim 9, wherein the first driving gas, the second driving gas, the first enabling gas and the second enabling gas are compressed dry air (CDA).

* * * * *